US010230151B2

(12) United States Patent
Moore

(10) Patent No.: US 10,230,151 B2
(45) Date of Patent: Mar. 12, 2019

(54) MOUNTING ASSEMBLY PROVIDING FOR MOVEMENT ABOUT MULTIPLE AXES

(71) Applicant: GOJO Industries, Inc., Akron, OH (US)

(72) Inventor: Mark W. Moore, Aurora, OH (US)

(73) Assignee: GOJO Industries, Inc, Akron, OH (US)

( * ) Notice: Subject to any disclaimer, the term of this patent is extended or adjusted under 35 U.S.C. 154(b) by 252 days.

(21) Appl. No.: 14/593,153

(22) Filed: Jan. 9, 2015

(65) Prior Publication Data

US 2015/0200439 A1 Jul. 16, 2015

Related U.S. Application Data

(60) Provisional application No. 61/925,962, filed on Jan. 10, 2014.

(51) Int. Cl.

| | |
|---|---|
| ***H01Q 1/08*** | (2006.01) |
| ***H01Q 1/12*** | (2006.01) |
| ***H01Q 1/10*** | (2006.01) |
| *H01Q 1/22* | (2006.01) |

(52) U.S. Cl.

CPC ..... *H01Q 1/084* (2013.01); *H01Q 1/088* (2013.01); *H01Q 1/106* (2013.01); *H01Q 1/125* (2013.01); *H01Q 1/2291* (2013.01); *Y10T 403/32008* (2015.01); *Y10T 403/32041* (2015.01); *Y10T 403/32581* (2015.01)

(58) Field of Classification Search

CPC ..... Y10T 403/32008; Y10T 403/32041; Y10T 403/32106; Y10T 403/32131; Y10T 403/3953; Y10T 403/4688; Y10T 403/4694; Y10T 403/66; Y10T 403/7015; Y10T 403/7073; Y10T 403/32155; Y10T 403/32557; Y10T 403/32951; Y10T 403/32581; H01Q 1/084; H01Q 1/088; H01Q 1/106; H01Q 1/125; H01Q 1/2291; F16C 11/10; F16C 11/00; F16C 11/02; F16C 11/04

USPC ..... 403/65, 68, 71, 113, 161, 195, 261, 263, 403/341, 353, 375, 116

See application file for complete search history.

(56) References Cited

U.S. PATENT DOCUMENTS 6,100,852 A * 8/2000 Calearo ..... H01Q 1/088 343/702
6,137,056 A * 10/2000 Miyazaki ..... H01R 9/0524 174/78

(Continued)

FOREIGN PATENT DOCUMENTS

CN 101686131 A 3/2010

OTHER PUBLICATIONS

Int. Search Report cited in PCT Application No. PCT/US2015/010763 dated Apr. 8, 2015, 10 pgs.

*Primary Examiner* — Josh Skroupa
*Assistant Examiner* — Cory B Siegert
(74) *Attorney, Agent, or Firm* — Cooper Legal Group, LLC

(57) ABSTRACT

A network assembly includes an antenna sleeve for supporting an antenna. The network assembly includes a mounting assembly for movably attaching the antenna sleeve to a network device. The mounting assembly is movable with respect to the network device about a first axis. The antenna sleeve is movable with respect to the mounting assembly about a second axis.

10 Claims, 5 Drawing Sheets

(56) References Cited

U.S. PATENT DOCUMENTS

| | | | | |
|---|---|---|---|---|
| 6,362,794 | B1 * | 3/2002 | Yu | H01Q 1/084 343/702 |
| 6,839,033 | B2 * | 1/2005 | Shimabara | H01Q 1/10 343/702 |
| 6,989,798 | B2 * | 1/2006 | Wu | H01Q 1/084 343/878 |
| 7,193,570 | B2 * | 3/2007 | Liu | H01Q 1/084 343/700 MS |
| 7,233,292 | B2 * | 6/2007 | Chan | H01Q 1/084 343/702 |
| 7,400,301 | B2 * | 7/2008 | Chan | H01Q 1/084 343/702 |
| 7,532,167 | B2 * | 5/2009 | Liang | H01Q 1/084 343/702 |
| 7,567,217 | B1 * | 7/2009 | Chen | H01Q 1/084 343/702 |
| 2004/0090386 | A1 | 5/2004 | Shimabara et al. | |
| 2004/0257299 | A1 | 12/2004 | Tai et al. | |
| 2005/0128163 | A1 | 6/2005 | Liu | |
| 2006/0273980 | A1 | 12/2006 | Chan | |
| 2008/0030409 | A1 * | 2/2008 | Shih | H01Q 1/084 343/702 |
| 2008/0122730 | A1 * | 5/2008 | Lin | H01Q 1/084 343/878 |
| 2008/0191960 | A1 * | 8/2008 | Wang | H01Q 1/084 343/882 |

* cited by examiner

MOUNTING ASSEMBLY PROVIDING FOR MOVEMENT ABOUT MULTIPLE AXES

CROSS-REFERENCE TO RELATED APPLICATIONS

This application claims priority to U.S. Provisional Patent Application No. 61/925,962, filed on Jan. 10, 2014, the entire disclosure of which is hereby incorporated by reference.

TECHNICAL FIELD

The instant application is generally directed towards a mounting assembly. For example, the instant application is directed towards a mounting assembly for an antenna sleeve.

BACKGROUND

A network device can comprise an antenna sleeve for supporting an antenna. The antenna sleeve can be oriented to communicate with a device. A network device can be used, for example, in schools, hospitals, nursing homes, factories, restaurants, etc.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, a network assembly comprises an antenna sleeve for supporting an antenna. The network assembly comprises a mounting assembly for movably attaching the antenna sleeve to a network device. The mounting assembly is movable with respect to the network device about a first axis. The antenna sleeve is movable with respect to the mounting assembly about a second axis.

In another example, a network assembly comprises an antenna sleeve for supporting an antenna. The network assembly comprises a mounting assembly for movably attaching the antenna sleeve to a network device. The mounting assembly comprises a pivot structure movably attached to the network device, the pivot structure movable about a first axis. The mounting assembly comprises an attachment structure for attaching the antenna sleeve to the pivot structure, wherein the antenna sleeve is movable with respect to the attachment structure about a second axis.

In another example, a network assembly comprises an antenna sleeve for supporting an antenna. The network assembly comprises a mounting assembly for movably attaching the antenna sleeve to a network device. The mounting assembly comprises a pivot structure movably attached to the network device, the pivot structure movable about a first axis. The mounting assembly comprises an attachment structure for attaching the antenna sleeve to the pivot structure, wherein the antenna sleeve is movable with respect to the attachment structure about a second axis.

The following description and annexed drawings set forth certain illustrative aspects and implementations. These are indicative of but a few of the various ways in which one or more aspects can be employed. Other aspects, advantages, and/or novel features of the disclosure will become apparent from the following detailed description when considered in conjunction with the annexed drawings.

DETAILED DESCRIPTION

Figure 1:
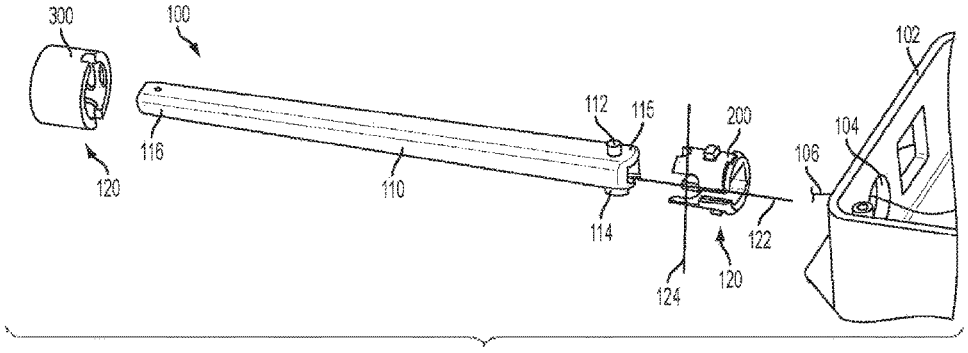
FIG. 1 is an illustration of an example network assembly.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter can be practiced without these specific details. In other instances, structures and devices are illustrated in block diagram form in order to facilitate describing the claimed subject matter.

Turning to FIG. 1, a network assembly 100 is illustrated. The network assembly 100 can be used to sense any number of conditions, such as, for example, a person's presence within an area. In an example, the network assembly 100 comprises a network device 102. The network device 102 can comprise any number of devices, comprising, but not limited to, receivers, transmitters, repeaters, electronic devices, wireless communication devices, or the like. In some examples, the network device 102 can communicate (e.g., with an antenna 106) with a second device, such as by transmitting and/or receiving information to/from the second device.

The network device 102 can comprise an opening 104 that extends between an interior and an exterior of the network device 102. In some examples, the opening 104 is sized and shaped to receive an antenna 106. For example, the antenna 106 can extend from the interior of the network device 102, through the opening 104, and to the exterior of the network device 102. The antenna 106 can comprise any number of sizes/shapes, such that in other examples, the opening 104 may be larger or smaller than illustrated in FIG. 1.

The network assembly 100 can comprise an antenna sleeve 110 for supporting the antenna 106. The antenna sleeve 110 is illustrated as being partially exploded and separated from the network device 102 for illustrative purposes and to more clearly show the structure of the antenna sleeve 110. In operation, the antenna sleeve 110 is substantially hollow, such that the antenna sleeve 110 can receive the antenna 106 within an interior of the antenna sleeve 110. The antenna sleeve 110 comprises any number of sizes/shapes, and in some examples, may be longer or shorter than as illustrated. In an example, the antenna sleeve 110 is movably attached with respect to the network device 102, such that the antenna sleeve 110, comprising the antenna 106, can be oriented/directed to pair with a target, such as a second network device (e.g., transmitter, receiver, etc.). By orienting the antenna sleeve 110, transmission of information to/from the antenna 106 is improved, such that a maximum transmission range of the antenna 106 is likewise improved. In this example, the antenna sleeve 110 can extend substantially linearly between a first end 115 and a second end 116, though other, non-linear shapes are envisioned.

The antenna sleeve 110 can comprise one or more axle portions that project outwardly from an outer surface of the antenna sleeve 110. The axle portions can facilitate movement of the antenna sleeve 110. In an example, the axle portions comprise a first axle portion 112 and a second axle portion 114 that are located at the first end 115 of the antenna sleeve 110. The first axle portion 112 and second axle portion 114 can extend outwardly from opposing sides of the antenna sleeve 110 (e.g., extending along a direction that is substantially transverse to a direction along which the antenna sleeve 110 extends). In an example, the first axle portion 112 and the second axle portion 114 have substantially rounded, circular shapes. In the illustrated example, the first axle portion 112 has a different cross-sectional size than the second axle portion 114. In other examples, however, the first axle portion 112 and second axle portion 114 can have substantially the same cross-sectional size. In one possible example, one or both of the first axle portion 112 and second axle portion 114 may comprise an opening through which the antenna 106 can be inserted into the antenna sleeve 110.

The network assembly 100 can comprise a mounting assembly 120 for movably attaching the antenna sleeve 110 to the network device 102. The mounting assembly 120 is illustrated as being partially exploded and separated from the network device 102 and antenna sleeve 110 for illustrative purposes and to more clearly show the structure of the mounting assembly 120. In operation, however, the mounting assembly 120 can be attached with respect to the network device 102. In an example, the mounting assembly 120 is movable with respect to the network device 102 about a first axis 122. In some examples, the antenna sleeve 110 is movable with respect to the mounting assembly 120 about a second axis 124. As illustrated in FIG. 2, the second axis 124 is substantially perpendicular to the first axis 122.

Figure 2A:
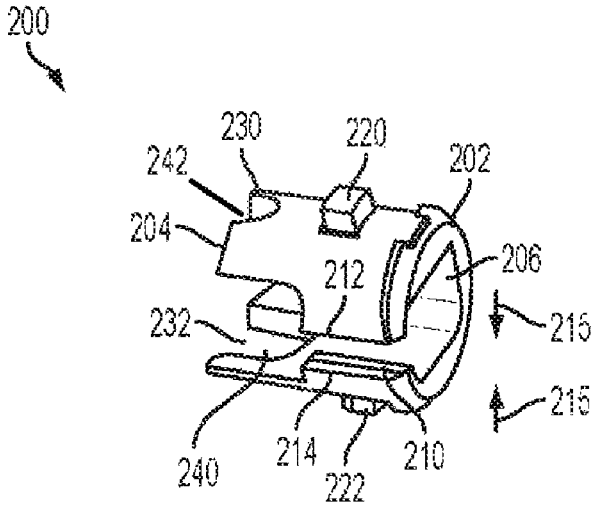
FIG. 2A is an illustration of a portion of an example network assembly.
Figure 2B:
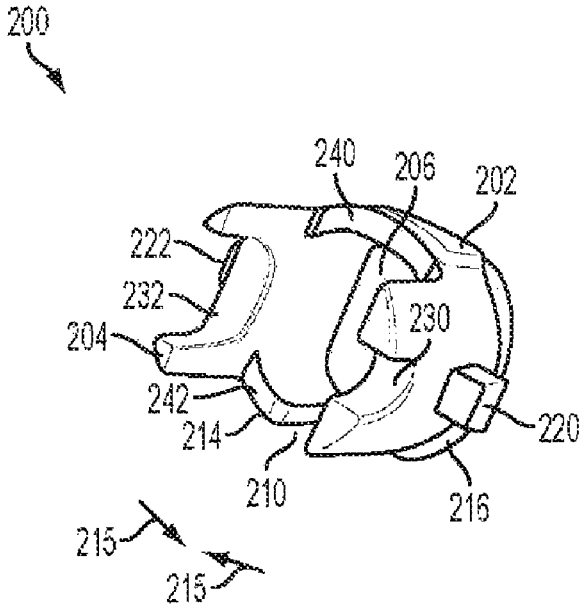
FIG. 2B is an illustration of a portion of an example network assembly.

Turning to FIGS. 2A and 2B, the mounting assembly 120 comprises a pivot structure 200 that is movably attached to the network device 102. In an example, the pivot structure 200 is movable about the first axis 122. The pivot structure 200 extends between a first end 202 and a second end 204. In some examples, the first end 202 of the pivot structure 200 can be removably inserted into the opening 104 of the network device 102. The pivot structure 200 can comprise a cross-sectional size/shape that matches the cross-sectional size/shape of the opening 104 of the network device 102. In an example, the pivot structure 200 can comprise a circular cross-sectional shape that is slightly larger than a circular cross-sectional shape of the opening 104. As such, the pivot structure 200 can be inserted into the opening 104 with a reduced likelihood of the pivot structure 200 being inadvertently removed from the opening 104 of the network device 102.

The mounting assembly 120 comprises an interior opening 206 that extends from the first end 202 to the second end 204. The interior opening 206 defines a substantially hollow space extending along a length of the pivot structure 200. In one possible example, the interior opening 206 is large enough such that the antenna 106 can pass through the interior opening 206 of the pivot structure 200 to the antenna sleeve 110.

The pivot structure 200 comprises an elongated flex opening 210 that extends at least partially along a length of the pivot structure 200. In an example, the flex opening 210 extends substantially parallel to the first axis 122. The flex opening 210 defines a space, gap, slit, or the like between a first side 212 and a second side 214 of the pivot structure 200. Accordingly, the first side 212 and the second side 214 of the pivot structure 200 are spaced apart to define the flex opening 210. In the illustrated examples of FIGS. 1, 2A and 2B, the pivot structure 200 comprises a first cross-sectional size in which the pivot structure 200 and the flex opening 210 are substantially not compressed.

In some examples, to insert the pivot structure 200 into the opening 104, the pivot structure 200 can be compressed (e.g., illustrated as compression direction 215), such that the cross-sectional size of the pivot structure 200 can be reduced. As the pivot structure 200 is compressed, the flex opening 210 is reduced in size with the first side 212 and second side 214 moving closer together. Upon being compressed, the pivot structure 200 can be inserted into the opening 104 of the network device 102, since a cross-sectional size of the pivot structure 200 (e.g., after being compressed) will be less than a cross-sectional size of the opening 104. After being inserted, the pivot structure 200 can, in some examples, revert to the uncompressed cross-sectional size of FIGS. 1, 2A and 2B.

To assist in attaching the pivot structure 200 to the opening 104, the pivot structure 200 can comprise an attachment ledge 216 located at the first end 202. The attachment ledge 216 comprises an outwardly extending radial projection. The attachment ledge 216 can extend partially or completely circumferentially around the pivot structure, such as from the first side 212 to the second side 214. In operation, the attachment ledge 216 can contact/abut the network device 102 around the opening 104. As such, the pivot structure 200 is substantially limited from being inadvertently removed from the opening 104.

The pivot structure 200 can comprise one or more pivot attachment portions. In an example, the one or more pivot attachment portions of the pivot structure 200 comprise a first pivot attachment portion 220 and a second pivot attachment portion 222. The first pivot attachment portion 220 and second pivot attachment portion 222 can extend radially outwardly from an outer surface of the pivot structure 200. In the illustrated example, the first pivot attachment portion 220 and second pivot attachment portion 222 are positioned substantially opposite each other. In other examples, however, the first pivot attachment portion 220 and second pivot attachment portion 222 can be positioned at nearly any location along the pivot structure 200. In one example, a line bisecting the first pivot attachment portion 220 and second pivot attachment portion 222 is substantially perpendicular to the first axis 122.

The pivot structure 200 can comprise one or more pivot structure openings. In an example, the one or more pivot structure openings of the pivot structure 200 comprise a first pivot structure opening 230 and a second pivot structure opening 232. In some examples, the first pivot structure opening 230 and second pivot structure opening 232 define openings, holes, spaces, or the like in the second end 204 of the pivot structure 200. In this example, the first pivot structure opening 230 and second pivot structure opening 232 are positioned substantially opposite each other. In other examples, however, the first pivot structure opening 230 and second pivot structure opening 232 can be positioned at nearly any location along the pivot structure 200.

The first pivot structure opening 230 and second pivot structure opening 232 can be the same size or different sizes (as illustrated). In one possible example, the first pivot structure opening 230 comprises a first cross-sectional size while the second pivot structure opening 232 comprises a second cross-sectional size. In the illustrated example, the first cross-sectional size of the first pivot structure opening 230 is smaller than the second cross-sectional size of the second pivot structure opening 232. In other examples, the first pivot structure opening 230 and second pivot structure opening 232 could be larger or smaller than as illustrated. Likewise, while the first pivot structure opening 230 and second pivot structure opening 232 have a substantially rounded shape in FIGS. 2A and 2B, other shapes, comprising circular, non-circular, non-rounded, etc., are envisioned.

The pivot structure 200 can comprise one or more movement openings. In an example, the one or more movement openings of the pivot structure 200 comprise a first movement opening 240 and a second movement opening 242. In some examples, the first movement opening 240 and second movement opening 242 define opening, holes, spaces, or the like in the second end 204 of the pivot structure 200. In this example, the first movement opening 240 and second movement opening 242 are positioned substantially opposite each other. In other examples, however, the first movement opening 240 and second movement opening 242 can be positioned at nearly any location along the pivot structure 200. In this example, the first movement opening 240 is positioned between the first pivot structure opening 230 and the second pivot structure opening 232. The second movement opening 242 can be positioned between the first pivot structure opening 230 and the second pivot structure opening 232 opposite the first movement opening 240.

One or both of the first movement opening 240 and second movement opening 242 can be sized and/or shaped to receive the antenna sleeve 110. For example, as will be described in more detail below, the antenna sleeve 110 can be movably attached to the pivot structure 200. As such, the antenna sleeve 110 can move/pivot with respect to the pivot structure 200 about the second axis 124. In an example, the antenna sleeve 110 can move into the first movement opening 240 and/or the second movement opening 242.

Figure 3A:
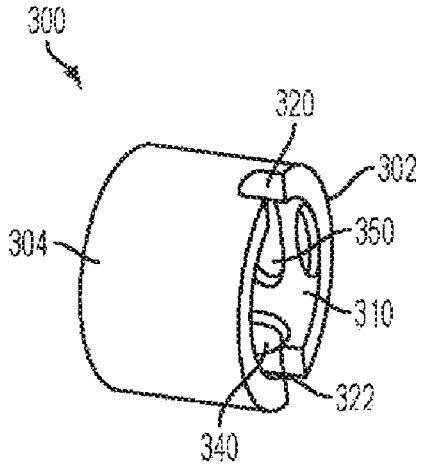
FIG. 3A is an illustration of a portion of an example network assembly.
Figure 3B:
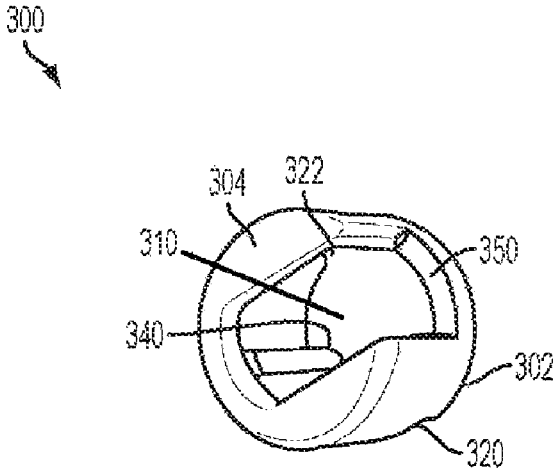
FIG. 3B is an illustration of a portion of an example network assembly.

Turning to FIGS. 3A and 3B, the mounting assembly 120 comprises an attachment structure 300 for attaching to the antenna sleeve 110. In an example, the attachment structure 300 can attach the antenna sleeve 110 to the pivot structure 200. As such, in some examples, the antenna sleeve 110 is movable with respect to the attachment structure 300 about the second axis 124. In an example, the attachment structure 300 extends between a first end 302 and a second end 304. In some examples, the attachment structure 300 comprises a mounting opening 310 through which the antenna sleeve 110 is received. In an example, the mounting opening 310 extends through the attachment structure 300 from the first end 302 to the second end 304.

The attachment structure 300 can comprise one or more attachment openings. In an example, the one or more attachment openings of the attachment structure 300 comprise a first attachment opening 320 and a second attachment opening 322. In some examples, the first attachment opening 320 and the second attachment opening 322 are positioned substantially opposite each other. In other examples, however, the first attachment opening 320 and second attachment opening 322 can be positioned at nearly any location along the pivot structure 200.

The first attachment opening 320 and second attachment opening 322 can be the same size (as illustrated) or different sizes. In one possible example, the first attachment opening 320 and second attachment opening 322 have a cross-sectional size that substantially matches or is slightly larger in size than the first pivot attachment portion 220 and second pivot attachment portion 222, respectively. For example, the first attachment opening 320 is sized/shaped to receive the first pivot attachment portion 220 while the second attachment opening 322 is sized/shaped to receive the second pivot attachment portion 222.

In operation, the first attachment opening 320 can receive the first pivot attachment portion 220 of the pivot structure 200 such that the attachment structure 300 is non-rotatable with respect to the pivot structure 200 Likewise, the second attachment opening 322 can receive the second pivot attachment portion 222 of the pivot structure 200 such that the attachment structure 300 is non-rotatable with respect to the pivot structure 200. By being non-rotatable, the pivot structure 200 is substantially limited from rotating about the first axis 122 with respect to the attachment structure 300. As such, when the attachment structure 300 is attached to the pivot structure 200, the attachment structure 300 is non-rotatable with respect to the pivot structure 200.

The attachment structure 300 can comprise an extension portion 340. The extension portion 340 extends from the first end 302 of the extension portion 340 in a direction that is substantially parallel to the first axis 122. The extension portion 340 comprises any number of sizes and shapes. For example, as illustrated, the extension portion 340 can extend in a substantially linear direction from the first end 302 of the extension portion 340. In other examples, the extension portion 340 can extend a longer or shorter distance than as shown or may extend non-linearly. In this example, the extension portion 340 comprises a width that is substantially equal to a width of the flex opening 210 of the pivot structure 200. As such, the extension portion 340 can be removably received within the flex opening 210 of the pivot structure 200.

In operation, the extension portion 340 can be removably received within the flex opening 210 such that when the extension portion 340 is received within the flex opening 210, the pivot structure 200 remains substantially fixed in cross-sectional size. For example, when the extension portion 340 is received within the flex opening 210, the first side 212 and second side 214 of the flex opening 210 can contact/abut the extension portion 340. As such, the flex opening 210 is substantially fixed in size due to the extension portion 340 limiting the first side 212 from flexing towards the second side 214.

Figure 4:
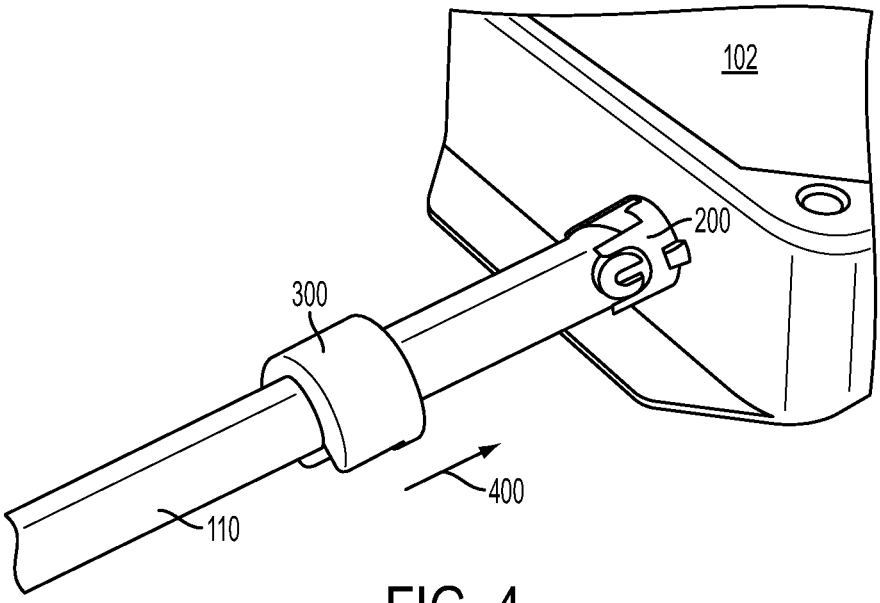
FIG. 4 is an illustration of an example network assembly.

Turning now to FIG. 4, the operation of the antenna sleeve 110 and mounting assembly 120 can be described. As illustrated, the pivot structure 200 can be inserted into the opening 104 of the network device 102. The pivot structure 200 is movable with respect to the network device 102 about the first axis 122. The antenna sleeve 110 can be attached to the pivot structure 200. In this example, the first axle portion 112 and second axle portion 114 can be received within the first pivot structure opening 230 and second pivot structure opening 232, respectively, of the pivot structure 200. With the first axle portion 112 received within the first pivot structure opening 230 and the second axle portion 114 received within the second pivot structure opening 232, the antenna sleeve 110 can rotate with respect to the pivot structure 200 about the second axis 124.

The attachment structure 300 can receive the antenna sleeve 110. In an example, the antenna sleeve 110 can be received within the mounting opening 310 of the attachment structure 300. The attachment structure 300 can be moved in a movement direction 400 towards the pivot structure 200.

Figure 5A:
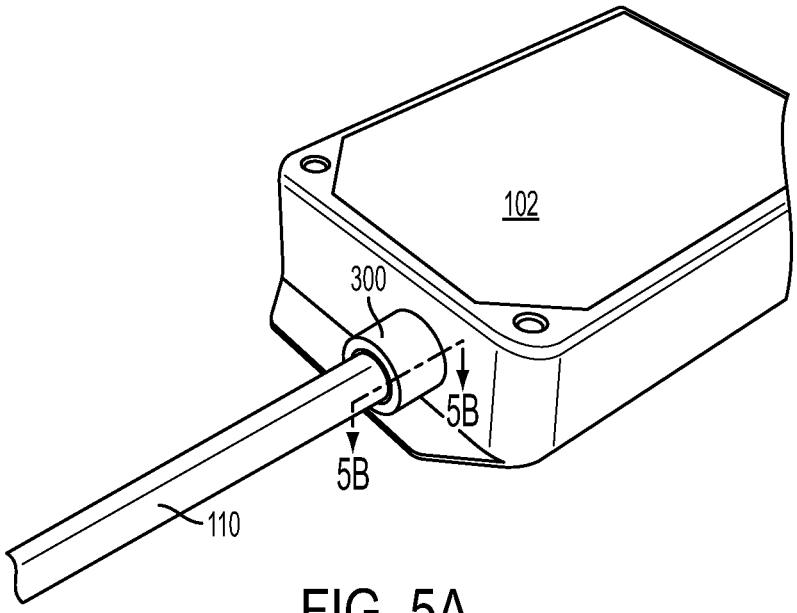
FIG. 5A is an illustration of an example network assembly.
Figure 5B:
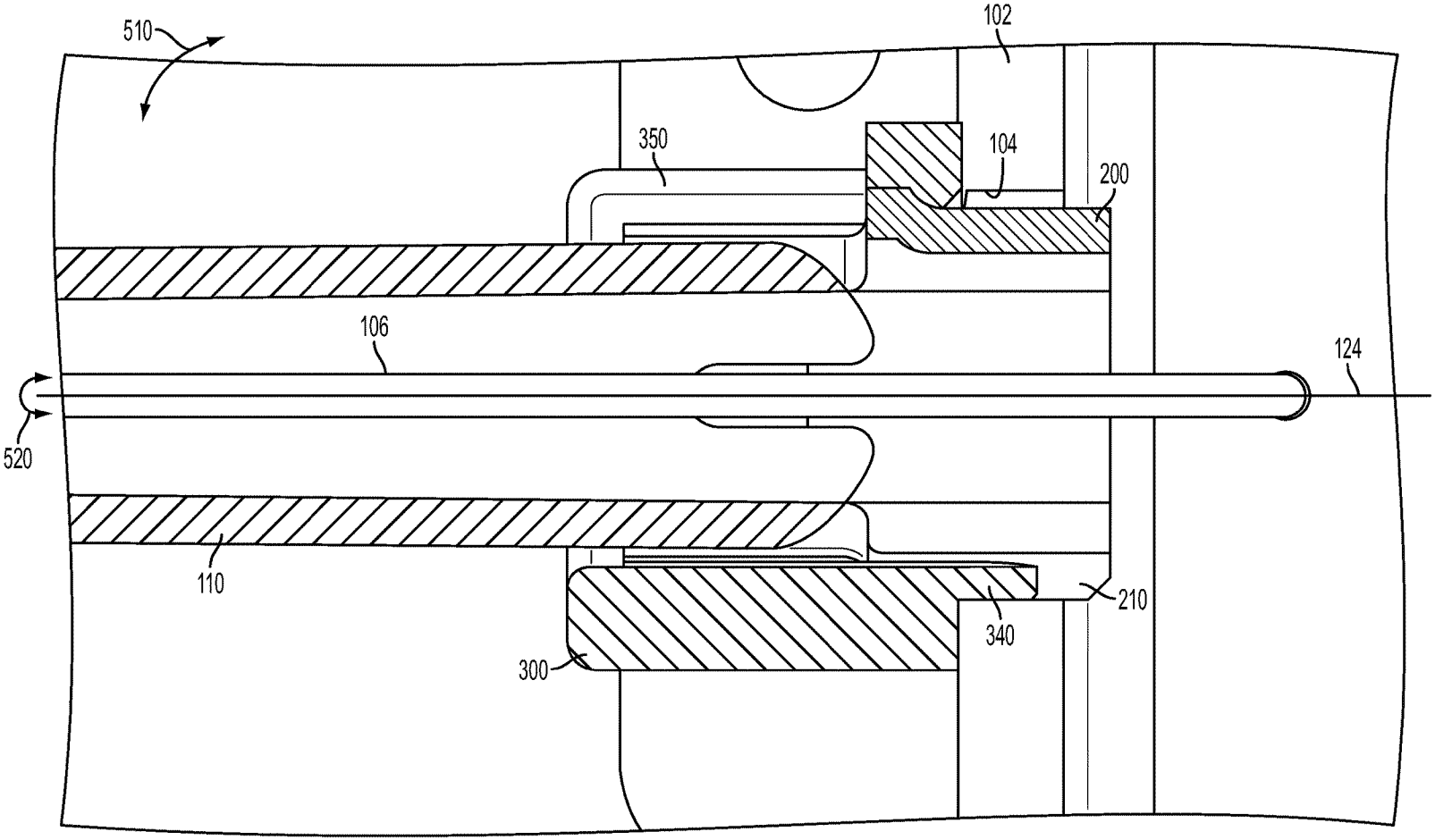
FIG. 5B is a partial section illustration of an example network assembly.

Turning now to FIGS. 5A and 5B, the attachment structure 300 can be attached to the pivot structure 200. FIG. 5B illustrates the mounting assembly 120 along lines 5B-5B of FIG. 5A. As illustrated, the extension portion 340 of the attachment structure 300 can extend into the flex opening 210 Likewise, the extension portion 340 can extend at least partially into the opening 104 of the network device 102. As such, the extension portion 340 can block and/or limit the pivot structure 200 from compressing (e.g., in the compression direction 215 of FIGS. 2A and 2B) such that the pivot structure 200 remains substantially fixed in cross-sectional size. Accordingly, the pivot structure 200 is substantially limited from being inadvertently removed from the opening 104.

With the attachment structure 300 attached to the pivot structure 200, the antenna sleeve 110, comprising the antenna 106, is free to move about the first axis 122 and/or the second axis 124. For example, the antenna sleeve 110 can be rotated into the pivot opening 350 of the attachment structure 300, such that the antenna sleeve 110 can move about the second axis 124 along a second movement direction 510. In an example, the pivot structure 200, which supports the antenna sleeve 110, can move about the first axis 122 along a first movement direction 520 by rotating with respect to the network device 102. Accordingly, the mounting assembly 120, comprising the pivot structure 200 and attachment structure 300, allows for the antenna 106 and antenna sleeve 110 to move in a plurality of directions. As such, the antenna 106 and antenna sleeve 110 can be oriented to pair with another network device, thus improving the transmission and/or reception range of the antenna 106.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing at least some of the claims.

Various operations of embodiments are provided herein. The order in which some or all of the operations described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first end and a second end generally correspond to end A and end B or two different or two identical ends or the same end.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally to be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used in either the detailed description or the claims, such terms are intended to be inclusive in a manner similar to "comprising".

Also, although the disclosure has been illustrated and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A network assembly comprising:

an antenna sleeve for supporting an antenna, the antenna sleeve comprising:

a first axle portion that extends outwardly from a first surface of the antenna sleeve; and a mounting assembly for movably attaching the antenna sleeve to a network device, the mounting assembly comprising:

a pivot structure movably received within an opening defined by the network device, the pivot structure movable about a first axis, the pivot structure extending along the first axis between a first end, that is configured to be received within the opening, and a second end, that is attached to the antenna sleeve, the pivot structure defining an elongated flex opening that extends along a length of the pivot structure from the first end to the second end such that the pivot structure is compressible between:

an uncompressed state in which:

the first end of the pivot structure has a first cross-sectional size that is greater than an opening cross-sectional size of the opening of the network device, and the flex opening has a first width at the first end; and a compressed state in which:

the first end of the pivot structure has a second cross-sectional size that is less than the opening cross-sectional size of the opening of the network device, and the flex opening has a second width at the first end that is less than the first width; and an attachment structure for attaching the antenna sleeve to the pivot structure, wherein the attachment structure engages a first portion of the first axle portion and the pivot structure engages a second portion of the first axle portion such that the antenna sleeve is movable with respect to the attachment structure about a second axis.

2. The network assembly of claim 1, wherein the second axis is substantially perpendicular to the first axis.

3. The network assembly of claim 1, wherein the elongated flex opening is defined between a first side and a second side of the pivot structure, the first width and the second width defined between the first side and the second side.

4. The network assembly of claim 1, wherein the flex opening extends substantially parallel to the first axis.

5. The network assembly of claim 1, wherein the attachment structure comprises an extension portion that is configured to be removably received within the flex opening of the pivot structure such that when the extension portion is received within the flex opening, the pivot structure remains substantially fixed in cross-sectional size.

6. The network assembly of claim 1, wherein the attachment structure comprises a mounting opening through which the antenna sleeve is received.

7. The network assembly of claim 1, wherein the attachment structure comprises a pivot opening into which the antenna sleeve is movable when the antenna sleeve moves about the second axis.

8. The network assembly of claim 1, comprising a first pivot attachment portion that extends outwardly from the pivot structure.

9. The network assembly of claim 8, wherein the attachment structure comprises a first attachment opening that is configured to receive the first pivot attachment portion of the pivot structure such that the attachment structure is non-rotatable with respect to the pivot structure.

10. A mounting assembly for a network device, the mounting assembly comprising:

a pivot structure movably received within an opening defined by a wall of the network device, the pivot structure movable about a first axis, the pivot structure extending along the first axis between a first end and a second end, the pivot structure defining an elongated flex opening that extends along a length of the pivot structure from the first end to the second end such that the pivot structure is compressible, the pivot structure comprising:

an attachment ledge extending outwardly from a first surface of the pivot structure, the pivot structure having a first pivot cross-sectional size at the attachment ledge; and a pivot attachment portion extending outwardly from a second surface of the pivot structure, the pivot structure having a second pivot cross-sectional size at the first pivot attachment portion;

wherein, when the pivot structure is movably received within the opening, an opening cross-sectional size of the opening is less than the first pivot cross-sectional size and is less than the second pivot cross-sectional size, and the attachment ledge is disposed on a first side of the wall and the pivot attachment portion is disposed on a second side of the wall; and an attachment structure configured to attach an antenna sleeve to the pivot structure, wherein the antenna sleeve is movable with respect to the attachment structure about a second axis that is substantially perpendicular to the first axis, wherein when the attachment structure is attached to the pivot structure the attachment structure is non-rotatable with respect to the pivot structure.

* * * * *